US011305530B2

(12) United States Patent
Okazaki et al.

(10) Patent No.: US 11,305,530 B2
(45) Date of Patent: Apr. 19, 2022

(54) PRINTING APPARATUS AND METHOD OF CONTROLLING PRINTING APPARATUS

(71) Applicant: SEIKO EPSON CORPORATION, Tokyo (JP)

(72) Inventors: Shinya Okazaki, Shiojiri (JP); Shinichi Yoshie, Tatsuno-Machi (JP)

(73) Assignee: Seiko Epson Corporation, Tokyo (JP)

( * ) Notice: Subject to any disclaimer, the term of this patent is extended or adjusted under 35 U.S.C. 154(b) by 70 days.

(21) Appl. No.: 17/025,488

(22) Filed: Sep. 18, 2020

(65) Prior Publication Data

US 2021/0086507 A1 Mar. 25, 2021

(30) Foreign Application Priority Data

Sep. 20, 2019 (JP) ..... JP2019-171524

(51) Int. Cl.
*B41J 2/045* (2006.01)
*B41J 11/42* (2006.01)

(52) U.S. Cl.
CPC ..... *B41J 2/04541* (2013.01); *B41J 2/0455* (2013.01); *B41J 11/42* (2013.01)

(58) Field of Classification Search
CPC ... B41J 2/35; B41J 2/355; B41J 2/3551; B41J 2/3553; B41J 2/3555; B41J 2/3556; B41J 2/3558; B41J 2/33505; B41J 2/32; H01R 12/71; H01R 13/639
See application file for complete search history.

(56) References Cited

U.S. PATENT DOCUMENTS 4,831,395 A * 5/1989 Pham ..... G06K 15/1247 347/237
7,025,517 B2 4/2006 Inaba
2005/0117013 A1* 6/2005 Hayashi ..... B41J 2/355 347/179

FOREIGN PATENT DOCUMENTS

JP 2001054959 * 2/2001 ..... B41J 2/45
JP 2005-41086 A 2/2005

* cited by examiner

*Primary Examiner* — Kristal Feggins
(74) *Attorney, Agent, or Firm* — Workman Nydegger

(57) ABSTRACT

A printing apparatus includes: a variable resistance circuit including a plurality of resistors intercoupled and one or more drive elements that feed currents through the respective resistors; an optical sensor coupled to the variable resistance circuit; a shift register that outputs signals to select one or more of the drive elements and to turn on the selected drive elements; and a controller that acquires a detection value of the optical sensor and that controls the shift register based on the detection value.

6 Claims, 6 Drawing Sheets

PRINTING APPARATUS AND METHOD OF CONTROLLING PRINTING APPARATUS

The present application is based on, and claims priority from JP Application Serial Number 2019-171524, filed Sep. 20, 2019, the disclosure of which is hereby incorporated by reference herein in its entirety.

BACKGROUND

1. Technical Field

The present disclosure relates to a printing apparatus and a method of controlling the printing apparatus.

2. Related Art

As known in the art, the sensitivities of optical sensors tend to greatly vary. Thus, when an optical sensor is used as a detector, the load resistance for the detector is adjusted in order to absorb the difference in sensitivity from other optical sensors. This adjustment is needed especially when the detector is mounted in a circuit that reads analog-to-digital (AD) values. It should be noted that such optical sensors are sometimes referred to as photosensors.

For example, JP-A-2005-41086 discloses a printer that includes: an optical sensor that detects gaps between labels or marks on an elongated sheet; and a volume resistor to be adjusted in accordance with the sensitivity of the optical sensor (refer to the paragraph 0045). Examples of this volume resistor include a preset resistor, a trimmer potentiometer, and a trimmer analog variable resistor.

Since the sensitivities of optical sensors tend to greatly vary as described above, it is necessary to adjust the resistance in a transmitter circuit in which a light-emitting diode is mounted or a receiver circuit in which a phototransistor is mounted.

In the disclosed printer, for example, the resistance of the volume resistor, which has a mechanical structure, is typically adjusted in a manual manner. However, if the adjusted volume resistor is replaced with a new one because of repair or maintenance work, it is necessary to adjust the resistance of the new volume resistor again. Moreover, the adjustment nob of the adjusted volume resistor needs to be fixed with an adhesive bond, for example, in order to prevent the adjustment nob from being displaced.

As an example, if a trimmer analog variable resistor is used as a load resistance for an optical sensor, it is necessary to manually adjust the trimmer position of this trimmer analog variable resistor in such a way that the optical sensor outputs an expected level of voltage. However, if the substrate on which the variable resistance circuit is mounted is replaced with a new one because of maintenance work, for example, it may be necessary to manually adjust the trimmer position again because the adjusted resistance value is difficult to reuse.

As another example, if a digital potentiometer (DPM) is used as a load resistance for an optical sensor, it is necessary to adjust the resistance of the DPM in such a way that the optical sensor outputs an expected level of voltage. When the substrate on which the variable resistance circuit is mounted is replaced with a new one because of maintenance work, for example, it is possible to reuse the adjusted resistance value by saving this value in nonvolatile memory, for example. However, the resistance of the new DPM may somewhat differ from the expected value because the tolerance of resistance values of DPMs is typically in the range of ±30% or more. If this difference is unacceptable, it is necessary to manually adjust the resistance of the new DPM again.

SUMMARY

The present disclosure is a printing apparatus that includes a variable resistance circuit that includes a plurality of resistors intercoupled and one or more drive elements that feed currents through the respective resistors. An optical sensor is coupled to the variable resistance circuit. A shift register outputs signals to the variable resistance circuit to select one or more of the drive elements and to turn on the selected drive elements. A controller acquires a detection value of the optical sensor and controls the shift register based on the detection value.

The present disclosure is a method of controlling a printing apparatus that includes a variable resistance circuit including a plurality of resistors intercoupled and one or more drive elements that feed currents through the respective resistors. An optical sensor is coupled to the variable resistance circuit. A shift register outputs signals to the variable resistance circuit to select one or more of the drive elements and to turn on the selected drive elements. A controller acquires a detection value of the optical sensor and controls the shift register based on the detection value. The method includes causing a controller in the printing apparatus to acquire a detection value from the optical sensor and to control the shift register based on the detection value.

DESCRIPTION OF EXEMPLARY EMBODIMENTS

Figure 1:
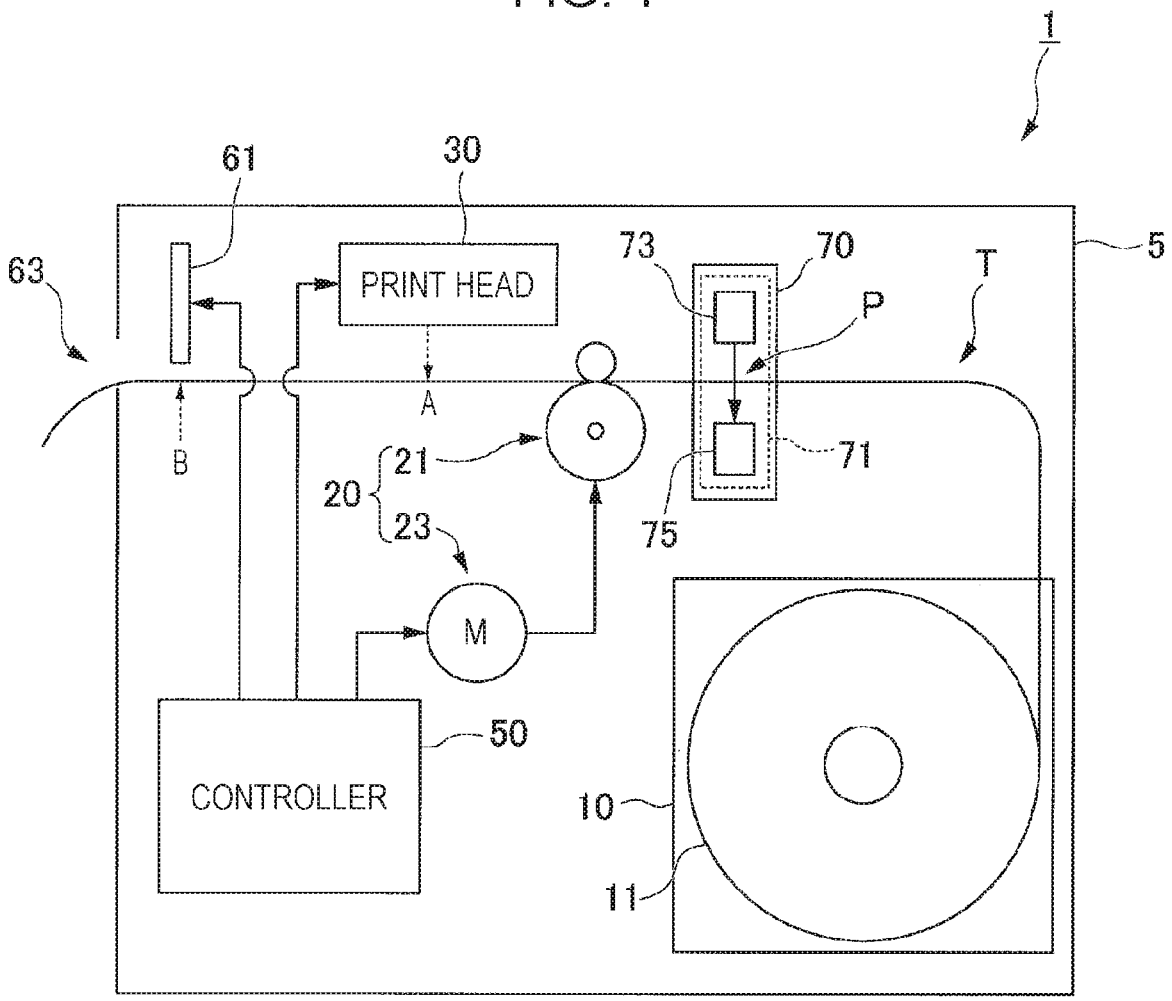
FIG. 1 illustrates a schematic configuration of a printing apparatus according to an embodiment of the present disclosure.

Some embodiments of the present disclosure will be described below with reference to the accompanying drawings. Configurations of Printing Apparatus and Recording Sheet FIG. 1 illustrates a schematic configuration of a printing apparatus 1 according to an embodiment of the present disclosure. The printing apparatus 1 includes a recording sheet container 10, a transport mechanism 20, a print head 30, controller 50, an automatic cutter 61, and a detector 70, all of which are incorporated in a housing 5.

Figure 2:
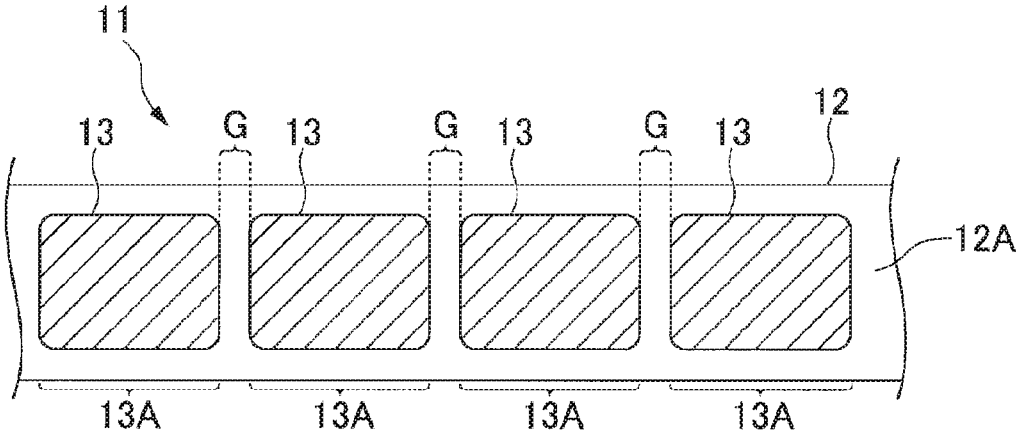
FIG. 2 is a plan view of a configuration of the recording sheet used in the printing apparatus.

FIG. 2 is a plan view of a configuration of a recording sheet 11 used in the printing apparatus 1. The recording sheet 11 is loaded into the recording sheet container 10 in the printing apparatus 1. The recording sheet 11 includes: a pasteboard 12 in an elongated shape; and a plurality of detection targets 13 bonded to the front surface of the pasteboard 12 so as to be arrayed at predetermined intervals. Provided between the detection targets 13 are gaps G having a predetermined size. In this embodiment, for convenience of explanation, the area of the recording sheet 11 in which only the pasteboard 12 is provided is referred to below as the pasteboard area 12A, whereas the areas of the recording sheet 11 in which the detection targets 13 are laminated on the pasteboard 12 are referred to below as detected areas 13A.

In this embodiment, each of the detection targets 13 may be a print area formed of a label or may be a mark such as a black mark. Each label or mark may be bonded to the pasteboard 12 with a pressure-sensitive adhesive or an adhesive bond, for example. The labels may be bonded to the front surface of the recording sheet 11, whereas the marks may be bonded to the rear surface. In short, the marks and the labels may be bonded to the opposite surfaces.

If each detection target 13 is a label, for example, a larger amount of light passes through the pasteboard area 12A than through each detected area 13A in the recording sheet 11. In this case, a transmissive optical sensor can be used to detect the pasteboard area 12A and the detected areas 13A. Such transmissive optical sensors are sometimes abbreviated as transmissive sensors. If each detection target 13 is a mark, for example, a larger amount of light is reflected on the pasteboard area 12A than on each detected area 13A in the recording sheet 11. In this case, a reflective optical sensor can be used to detect the pasteboard area 12A and the detected areas 13A. Such reflective optical sensors are sometimes abbreviated as reflective sensors. Hereinafter, a description will be given regarding the case where each detection target 13 is a label.

The pasteboard 12 may be an elongated, release-coated sheet having a uniform width, which is made of a resin film or synthetic paper, for example. In addition, each detection target 13 may be a white or other colored label seal. The front surface of the label is subjected to a surface treatment suitable for the type of a printer such as ink jet or thermo-sensitive type, whereas the rear surface is subjected to an adhesive treatment. Each of the pasteboard 12 and the labels may be made of any given material and have any given thickness and color in accordance with their application.

With reference to FIG. 1 again, the printing apparatus 1 will be described below. When the recording sheet 11 is loaded into the recording sheet container 10, the transport mechanism 20 feeds the front portion of the recording sheet 11 toward a print point A near the print head 30. The transport mechanism 20 includes: a transport roller 21; and a drive motor 23 that drives the transport roller 21. The housing 5 contains a transport route T that extends from the interior of the recording sheet container 10 to an ejection hole 63 through the print point A near the print head 30. The transport mechanism 20 feeds the recording sheet 11 from the recording sheet container 10 to the ejection hole 63 along the transport route T, under the control of the controller 50.

When a predetermined portion of the recording sheet 11 being fed by the transport mechanism 20 reaches the print point A, the print head 30 prints an image on this portion, under the control of the controller 50. Then, the transport mechanism 20 further feeds the portion of the recording sheet 11 to a cut point B near the automatic cutter 61, and the automatic cutter 61 cuts off this portion from the recording sheet 11, under the control of the controller 50. After that, the transport mechanism 20 ejects the cut-off portion to the outside of the housing 5 via the ejection hole 63.

The detector 70 with a first optical sensor 71 is disposed on the transport route T of the recording sheet 11 and upstream of the print point A near the print head 30. In this embodiment, the direction from the ejection hole 63 toward the recording sheet container 10 is defined as the upstream direction, whereas the opposite direction is defined as the downstream direction. The first optical sensor 71, which is implemented by a transmissive optical sensor, includes: a first light-emitting element 73 disposed above the transport route T; and a first light-receiving element 75 disposed below the transport route T. In this embodiment, the upper side with respect to the transport route T corresponds to the print head 30 side. Alternatively, the first light-emitting element 73 may be disposed below the transport route T, whereas the first light-receiving element 75 may be disposed above the transport route T. It should be noted that the upper and lower sides of the printing apparatus 1 does not necessarily have to coincide with those in the page of FIG. 1 and may be opposite.

The first light-emitting element 73 and the first light-receiving element 75 are arranged so as to face each other with the transport route T therebetween. When a portion of the recording sheet 11 passes through a detection point P on the transport route T, the first light-emitting element 73 emits detection light to the recording sheet 11, under the control of the controller 50. The detection point P is present on the transport route T, and the recording sheet 11 is irradiated with the detection light from the first light-emitting element 73 at the detection point P. This detection light passes through the recording sheet 11 and is received by the first light-receiving element 75. The amount of the detection light received by the first light-receiving element 75 when the pasteboard area 12A of the recording sheet 11 is positioned at the detection point P differs from that when a detected area 13A is positioned at the detection point P. Therefore, based on a varying detection voltage from the first light-receiving element 75, the controller 50 can determine which of the pasteboard area 12A and the detected area 13A is positioned at the detection point P. For example, by using a recording sheet 11 in which the difference in transmittance between the pasteboard area 12A and each detected area 13A is equal to or more than a predetermined threshold, the detection targets 13 of the recording sheet 11 can be detected accurately.

Figure 3:
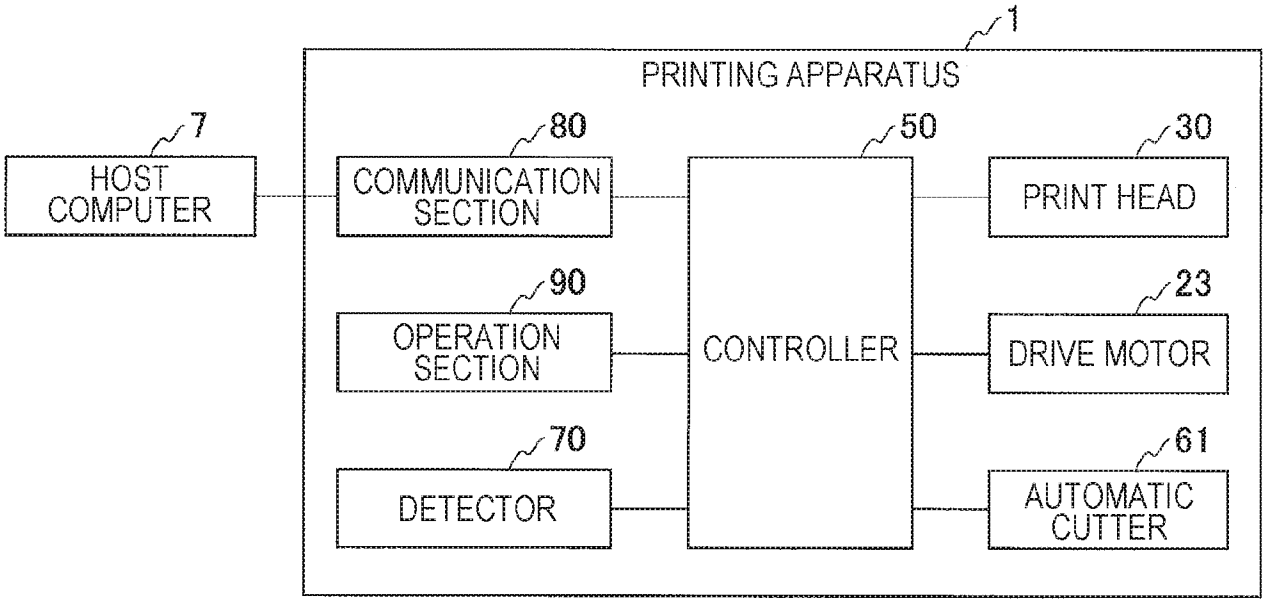
FIG. 3 is a block diagram of a control configuration of the printing apparatus.

FIG. 3 is a block diagram of a control configuration of the printing apparatus 1. The controller 50, which may be implemented by a central processing unit (CPU), micro processing unit (MPU), or other processor, is coupled to a communication section 80, which enables the printing apparatus 1 to communicate with a host computer 7. In the example of FIG. 3, the printing apparatus 1 is coupled to the host computer 7 via a wire; however, both of the printing apparatus 1 and the host computer 7 may be intercoupled via a wireless local area network (LAN) in conformity with a wireless connection specification such as Bluetooth (registered trademark).

When receiving print data from the host computer 7, the communication section 80 outputs this print data to the controller 50. The communication section 80 may also be referred to as the communication circuit, the communication interface, or the communication port. When receiving the print data from the communication section 80, the controller 50 starts to perform a print processing operation. In this print processing operation, the controller 50 drives the drive motor 23 to feed the recording sheet 11 along the transport route T. Meanwhile, the controller 50 expands the print data in a memory (not illustrated) and converts the print data into pixel-unit print data. Then, the controller 50 outputs the pixel-unit print data to the print head 30, thereby causing the print head 30 to print an image on a portion of the recording sheet 11 at the print point A. After that, the controller 50 drives the automatic cutter 61 to cut off the portion from the recording sheet 11 at the cut point B, based on a control command contained in the print data.

The controller 50 is also coupled to an operation section 90, which includes various operation keys, such as a power key by which the printing apparatus 1 is to be powered on or off and menu keys by which various settings are to be made. When a user operates any one of the operation keys, the operation section 90 outputs an operation signal to the controller 50 in accordance with the operated operation key.

The controller 50 is also coupled to the detector 70. The detector 70 performs predetermined processes, such as a current-voltage conversion, an amplification, and an analog-digital (AD) conversion, on the current flowing out from the first light-receiving element 75 which is proportional to the amount of light that the first light-receiving element 75 receives from the first light-emitting element 73, thereby generating a detection voltage. Then, the detector 70 outputs the detection voltage to the controller 50.

Upon the reception of the detection voltage, the controller 50 compares this detection voltage with a determination threshold stored in a memory, for example, thereby determining which of the detected area 13A and a pasteboard area 12A is positioned at the detection point P. The determination threshold may be preset such that the controller 50 can identify the difference between the detection voltages when the detection light from the detected area 13A passes through a detected area 13A and when the detection light passes through a pasteboard area 12A. Furthermore, the controller 50 can detect the front edge and rear edge of each detection target 13 by comparing the detection voltage with the determination threshold. Then, based on the time difference between when the front edge of the detection target 13 is detected and when the rear edge is detected and the speed at which the transport mechanism 20 feeds the recording sheet 11, for example, the controller 50 can detect the lengths of the detection targets 13 and the gaps G.

Configurations of Detector and Controller

Figure 4:
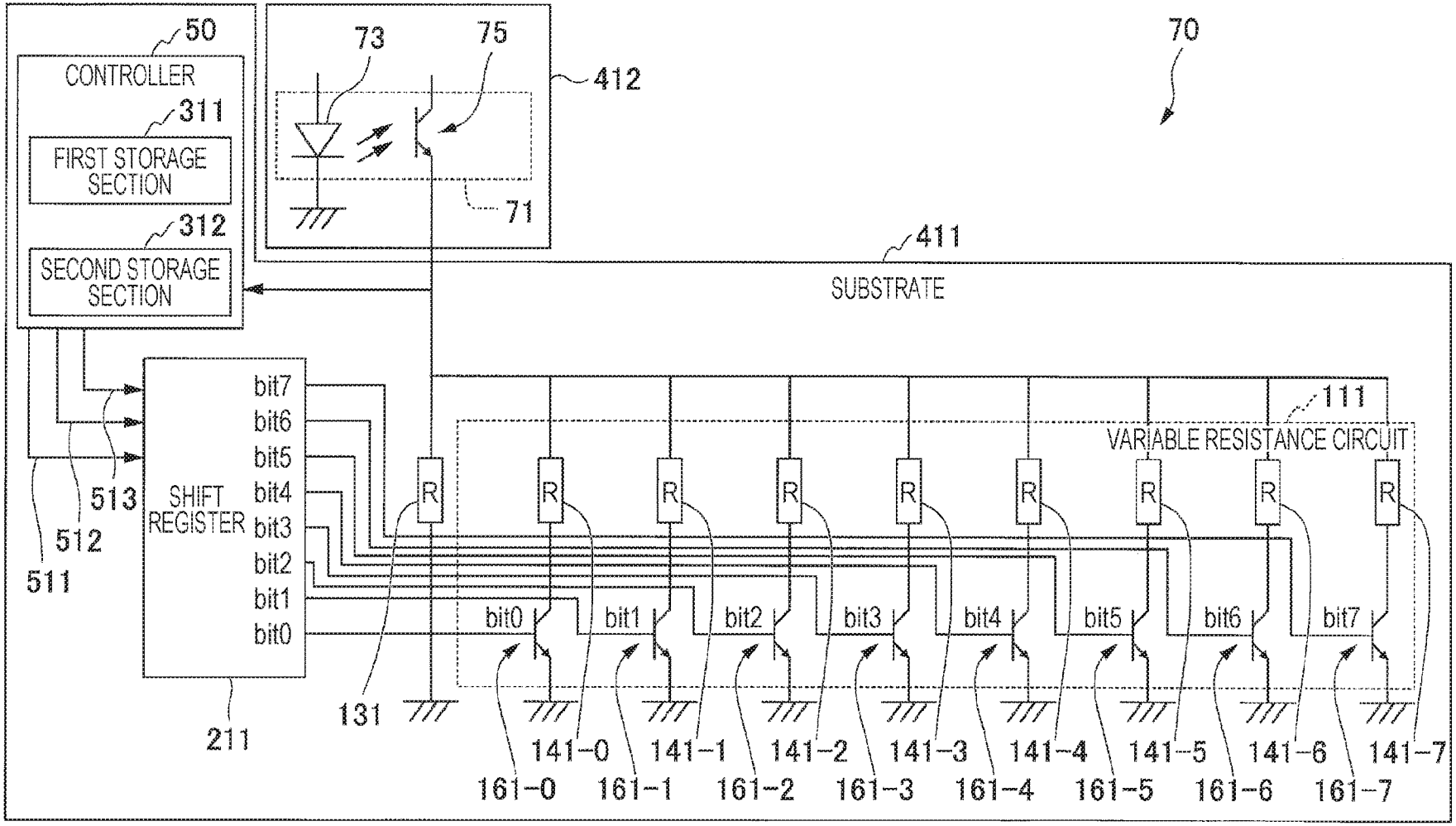
FIG. 4 is a block diagram of configurations of the detector and the controller.

FIG. 4 is a block diagram of configurations of the detector 70 and the controller 50. With reference to FIG. 4, the configurations of the controller 50 and the detector 70 will be described below in detail. The controller 50 may be implemented by a system on a chip (SoC). The detector 70 includes: the first optical sensor 71 with the first light-emitting element 73 and the first light-receiving element 75; a variable resistance circuit 111; an external resistor 131; and a shift register 211. The variable resistance circuit 111 includes eight resistors and eight drive elements. Further, the eight resistors include a zeroth resistor 141-0, a first resistor 141-1, a second resistor 141-2, a third resistor 141-3, a fourth resistor 141-4, a fifth resistor 141-5, a sixth resistor 141-5, and a seventh resistor 141-7; the eight drive elements include a zeroth drive element 161-0, a first drive element 161-1, a second drive element 161-2, a third drive element 161-3, a third drive element 161-3, a fourth drive element 161-4, a fifth drive element 161-5, a sixth drive element 161-6, and a seventh drive element 161-7. The zeroth resistor 141-0 to the seventh resistor 141-7 are coupled in parallel, and an external resistor 131 is further coupled in parallel to the zeroth resistor 141-0 to the seventh resistor 141-7.

In the variable resistance circuit 111, the zeroth drive element 161-0 is coupled between the zeroth resistor 141-0 and the ground. Likewise, the first drive element 161-1 is coupled between the first resistor 141-1 and the ground; the second drive element 161-2 is coupled between the second resistor 141-2 and the ground; the third drive element 161-3 is coupled between the third resistor 141-3 and the ground; the fourth drive element 161-4 is coupled between the fourth resistor 141-4 and the ground; the fifth drive element 161-5 is coupled between the fifth resistor 141-5 and the ground; the sixth drive element 161-6 is coupled between the sixth resistor 141-6 and the ground; and the seventh drive element 161-7 is coupled between the seventh resistor 141-7 and the ground. In this embodiment, each of the zeroth drive element 161-0 to the seventh drive element 161-7 may be a transistor, such as a field-effect transistor (FET). First ends of the zeroth resistor 141-0 to the seventh resistor 141-7 are all coupled to a first end of the external resistor 131. A second end of the zeroth resistor 141-0 is coupled to the collector of the zeroth drive element 161-0; a second end of the first resistor 141-1 is coupled to the collector of the first drive element 161-1; a second end of the second resistor 141-2 is coupled to the collector of the second drive element 161-2; a second end of the third resistor 141-3 is coupled to the collector of the third drive element 161-3; a second end of the fourth resistor 141-4 is coupled to the collector of the fourth drive element 161-4; a second end of the fifth resistor 141-5 is coupled to the collector of the fifth drive element 161-5; a second end of the sixth resistor 141-6 is coupled to the collector of the sixth drive element 161-6; and a second end of the seventh drive element 141-7 is coupled to the collector of the seventh drive element 161-7. The emitters of the zeroth drive element 161-0 to the seventh drive element 161-7 are all grounded.

A second end of the external resistor 131 is grounded. The first ends of the zeroth resistor 141-0 to the seventh resistor 141-7 and the external resistor 131 are all coupled to the output of the first light-receiving element 75 in the first optical sensor 71. In this embodiment, the detection voltage proportional to the current flowing out from the first light-receiving element 75 is applied to all the first ends of the zeroth resistor 141-0 to the seventh resistor 141-7 and the external resistor 131. Since the first ends of the zeroth resistor 141-0 to the seventh resistor 141-7 and the external resistor 131 are coupled to an input of the controller 50, the detection voltage, which is equivalent to the voltage across the external resistor 131, is applied to the input of the controller 50.

The resistances of the zeroth resistor 141-0 to the seventh resistor 141-7 in the variable resistance circuit 111 may be set to any given values. For example, the resistances of the zeroth resistor 141-0 to the seventh resistor 141-7 may be set to the same value, or one or more of the resistances of the zeroth resistor 141-0 to the seventh resistor 141-7 may be set to values different from the others. As an example, the resistance of the zeroth resistor 141-0 is 256 kΩ; the resistance of the first resistor 141-1 is 128 kΩ; the resistance of the second resistor 141-1 is 64 kΩ; the resistance of the third resistor 141-1 is 32 kΩ; the resistance of the fourth resistor 141-1 is 16 kΩ; the resistance of the fifth resistor 141-1 is 8 kΩ; the resistance of the sixth resistor 141-1 is 4 kΩ; and the resistance of the seventh resistor 141-7 is 2 kΩ. In addition, the resistance of the external resistor 131 is 22 kΩ. In this example, the zeroth resistor 141-0 to the seventh resistor 141-7 have different resistance values. The zeroth resistor 141-0 to the seventh resistor 141-7 and the external resistor 131 can be formed of resistances having small variations. The variations in these resistances can be typically within ±0.1%.

As an example, each of the zeroth resistor 141-0 to the seventh resistor 141-7 and the external resistor 131 is formed of one or more resistance elements. As an alternative example, each of the zeroth resistor 141-0 to the seventh resistor 141-7 and the external resistor 131 is formed of a resistance component contained in an element other than a resistance element.

The shift register 211 has three inputs and eight outputs. The outputs of the shift register 211 are coupled to the bases of the zeroth drive element 161-0 to the seventh drive element 161-7 in the variable resistance circuit 111. The controller 50 controls the voltages of signals to be output from the outputs of the shift register 211, thereby selectively turning on or off all of the zeroth drive element 161-0 to the seventh drive element 161-7. In this way, the shift register 211 selectively activates or inactivates the zeroth drive element 161-0 to the seventh drive element 161-7. In this embodiment, when any one of the zeroth drive element 161-0 to the seventh drive element 161-7 is turned on, the current flows from its collector to its emitter. When any one of the zeroth drive element 161-0 to the seventh drive element 161-7 is turned off, no current flows from its collector to its emitter.

When only the zeroth drive elements 161-0 and the first drive elements 161-1 are turned on, the total resistance of the variable resistance circuit 111 is equivalent to the total resistance (the combined resistance) of the zeroth resistor 141-0 and the first resistor 141-1 coupled, respectively, to the zeroth drive elements 161-0 and the first drive elements 161-1. The controller 50 can control the outputs of the shift register 211, thereby changing the total resistance of the variable resistance circuit 111. The total resistance of the detector 70 is equivalent to the total resistance (the combined resistance) of the variable resistance circuit 111 and the external resistor 131.

The outputs of the controller 50 are coupled to respective inputs of the shift register 211 via three signal lines, or a first signal line 511, a second signal line 512, and a third signal line 513. In the shift register 211, the first signal line 511 is supplied with a serial data signal, the second signal line 512 is supplied with a serial clock signal, and a third signal line 513 is supplied with a latch signal. In this way, those three signals are supplied from the controller 50 to the shift register 211. In response to the reception of the signals, the shift register 211 outputs eight signals to the variable resistance circuit 111 via the respective outputs. In this embodiment, the shift register 211 employs a serial-input and parallel-output configuration.

The controller 50 includes a first storage section 311 and a second storage section 312. For example, the first storage section 311 and the second storage section 312 are implemented by either different areas in the same storage unit or different storage units. In this embodiment, both of the first storage section 311 and the second storage section 312 are provided in the controller 50; however, one or both of the first storage section 311 and the second storage section 312 may be provided outside the controller 50. Each of the first storage section 311 and the second storage section 312 may be nonvolatile memory.

When the detection voltage, or the analog signal in this case, from the first light-receiving element 75 in the first optical sensor 71 is supplied to the input of the controller 50, the controller 50 converts this analog signal into digital signals and outputs the digital signals to the shift register 211. In this embodiment, the detection voltage from the first light-receiving element 75 is handled by an analog circuit disposed upstream of the controller 50 and, after output from the controller 50, is handled by a digital circuit disposed downstream of the controller 50.

The controller 50 outputs the serial data signal to the shift register 211 via the first signal line 511, outputs the serial clock signal via the second signal line 512, and outputs the latch signal via the third signal line 513.

Substrate

In this embodiment, the variable resistance circuit 111, the shift register 211, and the controller 50 are all mounted on a substrate 411. The first optical sensor 71 is mounted on a mount section 412, which is independent of the substrate 411. For example, the mount section 412 is separated from the substrate 411 and disposed inside the housing 5 of the printing apparatus 1 at a predetermined location.

Control Value for Shift Register

The first storage section 311 stores a value (control value) for controlling the shift register 211. The controller 50 reads the control value from the first storage section 311 and outputs this control value to the shift register 211. In this embodiment, the control value is represented by the serial data signal to be output from the controller 50 to the shift register 211. If the control value stored in the first storage section 311 has been set properly, the controller 50 can perform the control appropriately. The controller 50 may update this control value by changing it into a more proper one.

Figure 5:
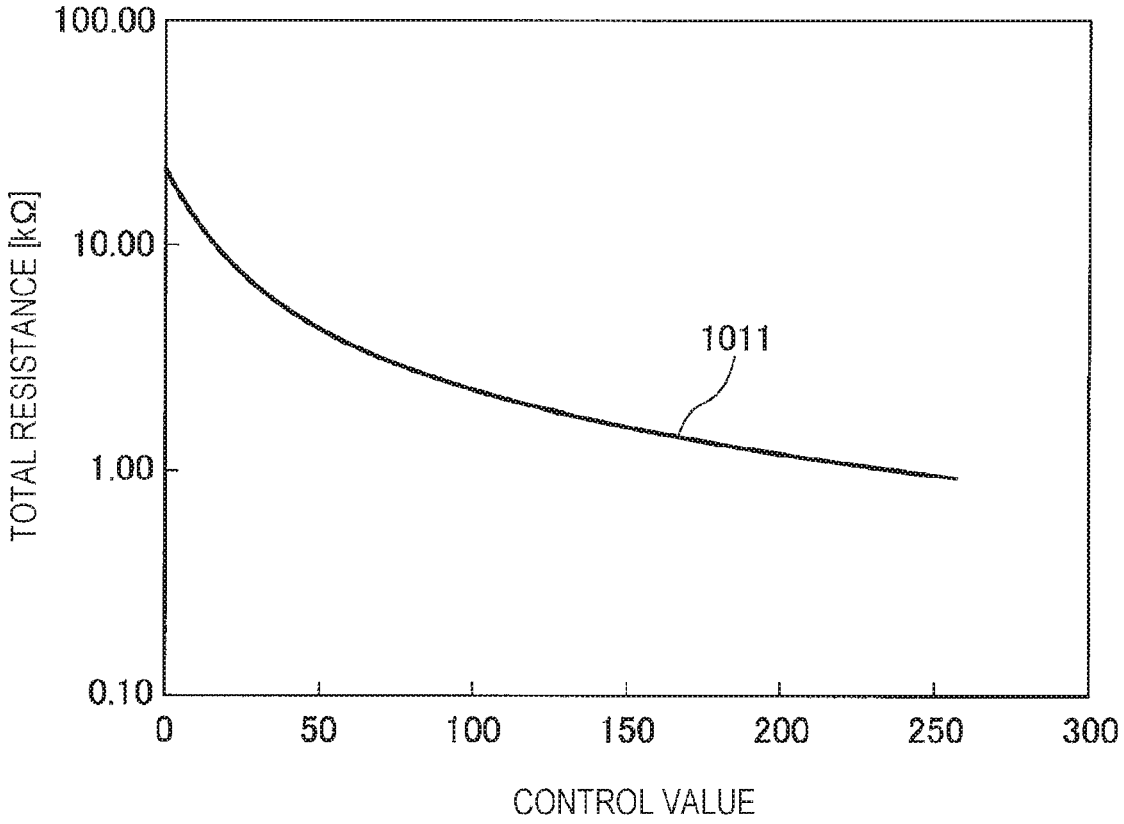
FIG. 5 is a graph representing the relationship between a control value for the shift register and a total resistance of the variable resistance circuit.

FIG. 5 is a graph representing the relationship between the control value for the shift register 211 and the total resistance of the variable resistance circuit 111. In this graph, the horizontal axis represents the control value for the shift register 211, and the vertical axis represents the total resistance (kΩ) of the variable resistance circuit 111. It should be noted that the vertical axis is a logarithmic scale. In the graph, the control value is expressed as 8-bit data in the range from 0 to 255. The relationship between the control value of the shift register 211 and the total resistance for the variable resistance circuit 111 is represented by a characteristic curve 1011.

In this embodiment, individual control values for the shift register 211 are related one-to-one to values of the total resistance of resistors in an ON state of the zeroth resistor 141-0 to the seventh resistor 141-7. As the control value for the shift register 211 is set to a larger one, the total resistance of the variable resistance circuit 111 decreases. Further, the total resistance of the variable resistance circuit 111 can vary from 1 kΩ to a value obtained when all the resistors are open. As can be seen from the graph of FIG. 5, as the control value supplied from the controller 50 to the shift register 211 increases, the total resistance of the variable resistance circuit 111 decreases.

Process of Determining Control Value With Controller

Figure 6:
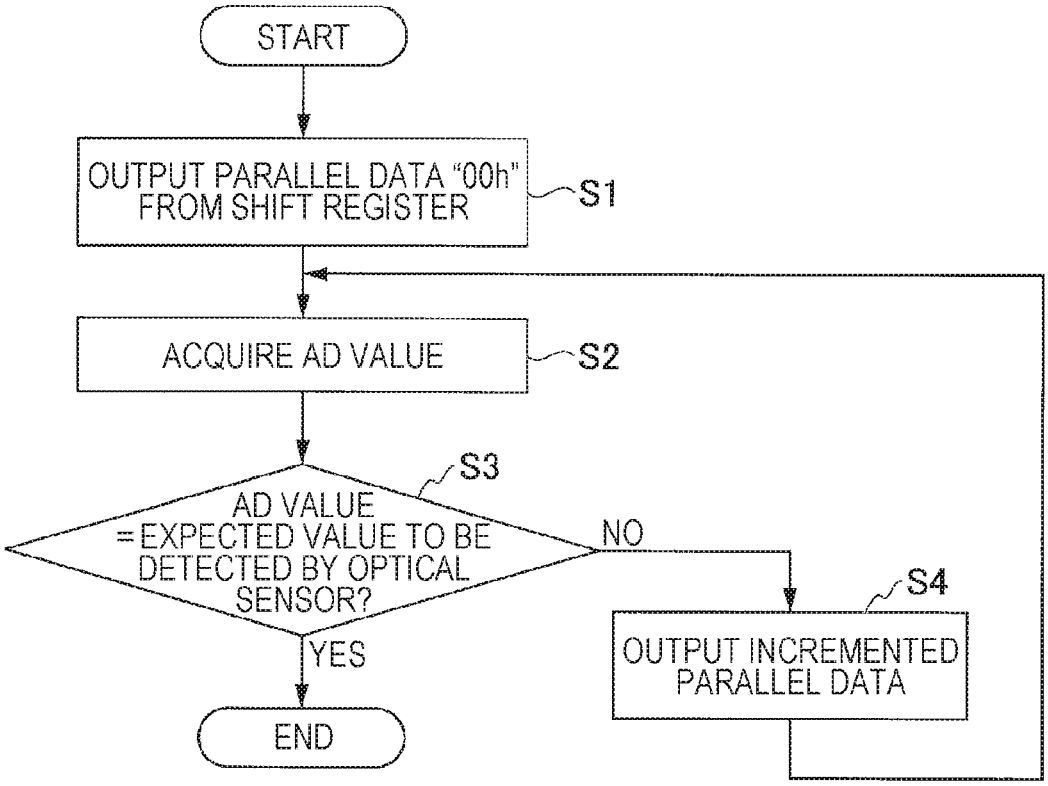
FIG. 6 is a flowchart of an example of a process in which the controller determines the control value.

FIG. 6 is a flowchart of an example of a process in which the controller 50 determines the control value. Through this process, the controller 50 determines a proper control value. In this embodiment, the controller 50 performs digital control to find a proper control value while varying a control value to be output to the shift register 211.

Step S1

The controller 50 sets a control value supplied to the shift register 211 in such a way that the shift register 211 outputs parallel data indicating a hexadecimal number "00h" to the variable resistance circuit 111. Then, the controller 50 makes the process proceeds to Step S2.

Step S2

The controller 50 receives, via its input, the analog signal from the first optical sensor 71 and acquires an AD value from this analog signal. This AD value is proportional to the detection voltage from the first light-receiving element 75 in the first optical sensor 71. Then, the controller 50 makes the process proceeds to Step S3.

Step S3

The controller 50 determines whether the received AD value equates with an expected value to be detected by the first optical sensor 71. In this case, the expected value may be preset and prestored in the first storage section 311. When determining that the AD value equates with the expected value (YES at Step S3), the controller 50 concludes this process. Then, the controller 50 designates the control value that has been set at Step S1 as a proper control value and stores this control value in the first storage section 311. From then on, the controller 50 controls the shift register 211 by using this control value. When determining that the AD value does not equate with the expected value (NO at Step S3), the controller 50 makes the process proceed to Step S4.

Step S4

The controller 50 sets the control value in such a way that the hexadecimal number in the parallel data that the shift register 211 outputs to the variable resistance circuit 111 increases, namely, increments by one. Then, the controller 50 makes the process return to Step S2.

In this process, for example, the AD value related to the detection value is set in such a way that the total resistance of the variable resistance circuit 111 is not saturated even when the AD value is maximized. In this embodiment, the signal-to-noise (S/N) ratio between the AD values acquired when the pasteboard area 12A is detected and when a detected area 13A is detected is sufficiently reserved. As an example, the AD value acquired when the pasteboard area 12A is detected is set to within the range from 2.5 to 3.0 V, and the AD value acquired when a detected area 13A is detected is set to within the range from 0.3 to 0.5 V.

In this embodiment, when the sensitivity of the first optical sensor 71 is high, the total resistance of the variable resistance circuit 111 is set to a value smaller than that when the sensitivity is low. According to the Ohm's law, the detection voltage related to the AD value equates with the product of the total resistance and the current flowing out from the first light-receiving element 75 in the first optical sensor 71. Thus, a larger amount of current flows through the first light-receiving element 75 when the sensitivity of the first optical sensor 71 than when the sensitivity is low. For this reason, when the sensitivity of the first optical sensor 71 is high, the total resistance of the variable resistance circuit 111 is set to a small value. In this embodiment, the total resistance of the variable resistance circuit 111 may be adjusted before the printing apparatus 1 is shipped out. For example, the total resistance of the variable resistance circuit 111 is adjusted in such a way that the AD value falls within the range from 0 to 3 V.

Figure 7:
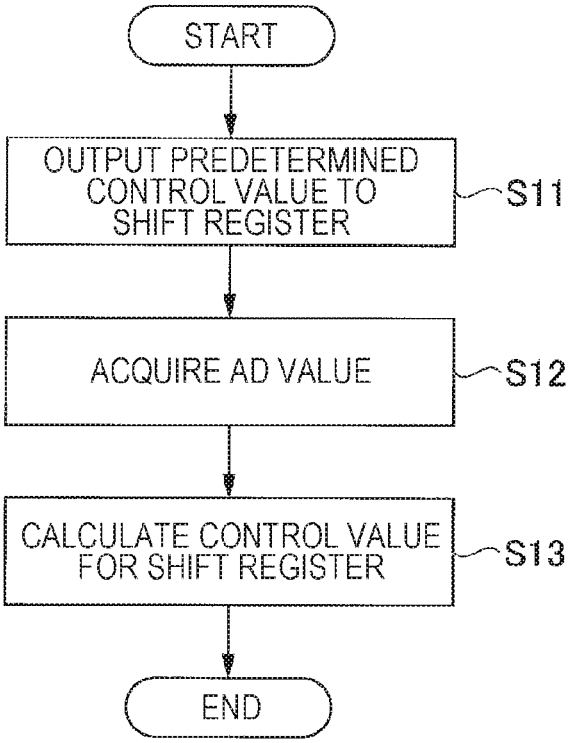
FIG. 7 is a flowchart of an example of a process in which the controller calculates the control value.

In the above process, the controller 50 increases the total resistance of the variable resistance circuit 111 in a stepwise manner; however, the controller 50 may decrease the total resistance in a stepwise manner. Process of Calculating Control Value with Controller FIG. 7 is a flowchart of an example of a process in which the controller 50 calculates a control value. In this process, the controller 50 calculates a proper control value. In this embodiment, the controller 50 automatically performs this process flow. For example, a predetermined value related to an AD value is prestored in the second storage section 312. This prestored value may be referred to as the target AD value.

In this process flow, a predetermined type of recording sheet 11 is used. The controller 50 calculates a control value proper for the type of recording sheet 11. Hereinafter, the procedures (Steps S11 to S13) for this process will be described.

Step S11

The controller 50 outputs a predetermined control value to the shift register 211. Then, the controller 50 makes the process proceeds to Step S12. This predetermined control value may be preset or determined in a random manner.

Step S12

The controller 50 receives an analog signal from the first optical sensor 71 via its input and acquires an AD value from this analog signal. This AD value is proportional to the detection voltage from the first light-receiving element 75 in the first optical sensor 71. Then, the controller 50 makes the process proceeds to Step S13.

In this embodiment, variations in the resistances of the zeroth resistor 141-0 to the seventh resistor 141-7 in the variable resistance circuit 111 can be reduced. Thus, the controller 50 can calculate the current flowing out from the first light-receiving element 75 in the first optical sensor 71, based on a varying resistance value, which corresponds to the total resistance of the variable resistance circuit 111, and the detection voltage from the first light-receiving element 75. Then, based on the calculated current, the controller 50 can precisely calculate the sensitivity of the first optical sensor 71. For example, the sensitivity of the first optical sensor 71 can be calculated from an equation expressed by ((detection voltage from first optical sensor 71)/(resistance of external resistor 131 and total resistance of variable resistance circuit 111). By using this equation, the controller 50 can recognize the sensitivity of the first optical sensor 71. It should be noted that the sensitivity of the first optical sensor 71 does not necessarily have to be recognized as a value in an absolute format. The sensitivity can be recognized as a value in any other data format as long as the controller 50 can reliably determine whether the control value is proper.

The recording sheet 11 may be any type of paper sheet, but its optical characteristic such as transmittance needs to be known in advance. Information regarding the optical characteristic of this paper sheet is preregistered in the second storage section 312. To register this information, a user may use a predetermined device to download it via a network.

Step S13

By using the predetermined value related to the AD value stored in the second storage section 312 and an acquired AD value, the controller 50 calculates the control value for the shift register 211 in such a way that the AD value acquired based on the detection voltage from the first optical sensor 71 equates with the predetermined value related to the AD value stored in the second storage unit 312. Through this process, the controller 50 adjusts the control value in accordance with the type of paper sheet used. Then, the controller 50 concludes this process flow.

For example, the controller 50 stores, in the first storage section 311, information on the type of recording sheet 11 for which a control value has been calculated and this control value in relation to each other. From then on, if the recording sheet 11 is used again, the controller 50 uses the control value related to the type of the recording sheet 11, based on the information stored in the first storage section 311. With this configuration, the printing apparatus 1 involves no adjustment process for a control value, for example, after a recording sheet is replaced with another.

For example, after loading a certain type of recording sheet 11 into the printing apparatus 1, the user may enter information on this type in the printing apparatus 1. If the controller 50 determines that a proper control value is already stored based on the information on the type, the controller 50 may use this control value. If the controller 50 determines that a proper control value is not stored based on the information on the type, the controller 50 may calculate a proper control value. In this embodiment, the controller 50 recognizes the sensitivity of the first optical sensor 71 and then calculates a control value for the shift register 211 by which a proper AD value can be acquired. This configuration successfully reduces the need for any adjustment process that would be performed, for example, every time a recording sheet is replaced with another.

In this embodiment, the controller 50 performs the process of FIG. 7 by using a preset type of recording sheet 11, thereby determining a control value for the variable resistance circuit 111 in such a way that the AD value equates with a predetermined value. This type of recording sheet 11 may be referred to as the adjusting or recommended sheet. If the printing apparatus 1 has a transmissive optical sensor, for example, the transmittance of the recording sheet 11 needs to be known in advance. In this case, the transmittance may be a value at a single point on the recording sheet 11 or a plurality of values within a predetermined area on the recording sheet 11. The plurality of values within the predetermined area fall within a predetermined range. In this embodiment, the second storage section 312 stores the AD value and the information regarding the recording sheet 11; this information is sometimes referred to as the profile information.

In this embodiment, for example, the AD value related to the detection value is set in such a way that the total resistance of the variable resistance circuit 111 is not saturated even when the AD value is maximized. In addition, the S/N ratio between the AD values acquired when the pasteboard area 12A is detected and when a detected area 13A is detected is sufficiently reserved. As an example, the AD value acquired when a pasteboard area 12A is detected is set to within the range from 2.5 to 3.0 V, and the AD value acquired when a detected area 13A is detected is set to within the range from 0.3 to 0.5 V.

Reflective Optical Sensor

In the example of FIGS. 1 and 4, the first optical sensor 71 is transmissive, and each detection target 13 on the recording sheet 11 is a label. As an alternative example, a reflective type of second optical sensor 71*a* may be used, and each detection target 13 on the recording sheet 11 may be a mark.

Figure 8:
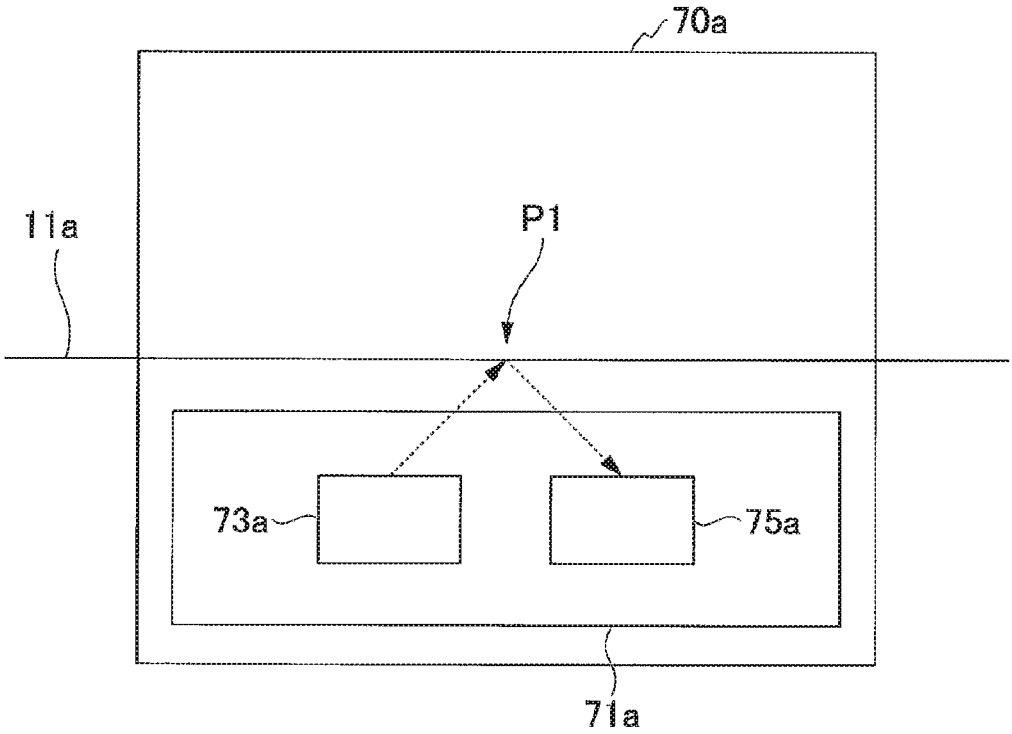
FIG. 8 illustrates a schematic configuration of the printing apparatus when the optical sensor is reflective.

FIG. 8 illustrates a schematic configuration of the printing apparatus 1 when the second optical sensor 71*a* is used. More specifically, FIG. 8 illustrates a reflective detector 70*a* provided with the second optical sensor 71*a*. The second optical sensor 71*a* includes a second light-emitting element 73*a* and a second light-receiving element 75*a*. FIG. 8 also illustrates a reflective detection point P1 and a reflective recording sheet 11*a* to be used for a reflective optical sensor. For the convenience of the explanation, reference characters different from those in FIGS. 1 and 4 are given to respective components in the example of FIG. 8.

The reflective detector 70*a* with the second optical sensor 71*a* is disposed on the transport route T for the reflective recording sheet 11*a* and upstream of the print point A near the print head 30. In this case, the reflective detector 70*a* with the reflective optical sensor may be disposed at the same location as the detector 70 with a transmissive optical sensor. The second optical sensor 71*a*, which is implemented by a reflective optical sensor, includes the second light-emitting element 73*a* and the second light-receiving element 75*a*, both of which are disposed below the transport route T. In this embodiment, the print head 30 side with respect to the transport route T corresponds to the upper side. Alternatively, both of the second light-emitting element 73*a* and the second light-receiving element 75*a* may be disposed above the transport route T.

As described above, both of the second light-emitting element 73*a* and the second light-receiving element 75*a* are disposed on the same side with respect to the transport route T. When a portion of the reflective recording sheet 11*a* passes through the reflective detection point P1 on the transport route T, the second light-emitting element 73*a* emits detection light to the reflective recording sheet 11*a*, under the control of the controller 50. The reflective detection point P1 is present on the transport route T, and the recording sheet 11 is irradiated with the detection light from the second light-emitting element 73*a* at the reflective detection point P1. The detection light from the second light-emitting element 73*a* is reflected by the reflective recording sheet 11*a* and is received by the second light-receiving element 75*a*. The amount of the detection light received by the second light-receiving element 75*a* when the pasteboard area 12A of the reflective recording sheet 11*a* is positioned at the reflective detection point P1 differs from that when a detected area 13A is positioned at the detection point P. Therefore, based on a varying detection voltage from the second light-receiving element 75*a*, the controller 50 can determine which of the pasteboard area 12A and the detected area 13A is positioned at the reflective detection point P1. For example, by using the reflective recording sheet 11*a* in which the difference in reflectance between the pasteboard areas 12A and the detected areas 13A is equal to or more than a predetermined threshold, the detection targets 13 on the recording sheet 11 can be detected accurately.

If the process of FIG. 7 is performed by the printing apparatus 1 with a reflective optical sensor, the reflectance of the reflective recording sheet 11*a* may be used as its optical characteristic. In short, if a reflective optical sensor is used, the reflectance of the reflective recording sheet 11*a* needs to be known in advance.

About Embodiment

According to the foregoing embodiment, a printing apparatus 1 sets a load resistance for a first optical sensor 71 or a second optical sensor 71*a* to a proper value. More specifically, the printing apparatus 1 sets a total resistance of a variable resistance circuit 111 to a proper value, in accordance with the sensitivity of the first optical sensor 71 or the second optical sensor 71*a*.

In the printing apparatus 1, information regarding the setting for the shift register 211 is stored, for example, in nonvolatile memory. Thus, when a substrate 411 on which the shift register 211 is mounted is replaced with another one, the printing apparatus 1 can retain the information regarding the total resistance of the variable resistance circuit 111 by retaining the information regarding the setting for the shift register 211. Thus, even after the replacement of the substrate 411, the printing apparatus 1 does not involve adjustment work for the first optical sensor 71 or the second optical sensor 71*a*.

After the variable resistance circuit 111 is replaced with a new one because of repair work, for example, the printing apparatus 1 involves no manual adjust work for the first optical sensor 71 or the second optical sensor 71*a*. This configuration achieves easy replacement of the variable resistance circuit 111. By using resistors having small variations for a zeroth resistor 141-0 to a seventh resistor 141-7 in the variable resistance circuit 111, a variation in the total resistance in the variable resistance circuit 111 can be reduced to, for example, approximately ±1%, which is smaller than that when a DPM is used.

The eight resistors, or the zeroth resistor 141-0 to the seventh resistor 141-7, are provided in the variable resistance circuit 111; however, any plural number of resistors may be provided in the variable resistance circuit 111. Likewise, the eight drive elements, or a zeroth drive element 161-0 to a seventh drive element 161-7, are provided in the variable resistance circuit 111; however, any number of drive elements may be provided in the variable resistance circuit 111.

The zeroth resistor 141-0 to the seventh resistor 141-7 are coupled in parallel in the variable resistance circuit 111; however, a plurality of resistors may be coupled in series or in both parallel and series. For example, if a plurality of resistors are coupled in series, some resisters are turned on by a corresponding drive element, and other resistors are turned off by being short-circuited by a signal line. Moreover, when a plurality of resistors are coupled, the resistors may be intercoupled either directly or indirectly.

Configuration Example

One configuration example is a printing apparatus (the printing apparatus 1 in the foregoing embodiment) that includes a variable resistance circuit (the variable resistance circuit 111 in the example of FIG. 4) including a plurality of resistors (the zeroth resistor 141-0 to the seventh resistor 141-7 in the example of FIG. 4) intercoupled and one or more drive elements (the zeroth drive element 161-0 to the seventh drive element 161-7 in the example of FIG. 4) that feed currents through the respective resistors. An optical sensor (the transmissive type of first optical sensor 71 or the reflective type of second optical sensor 71*a* in the embodiment) is coupled to the variable resistance circuit. A shift register (the shift register 211 in the example of FIG. 4) outputs signals to the variable resistance circuit to select one or more of the drive elements and to turn on the selected drive elements. A controller (the controller 50 in the example of FIG. 4) acquires a detection value of the optical sensor and controls the shift register based on the detection value.

In the printing apparatus, the optical sensor may be a transmissive sensor or a reflective sensor. The transmissive sensor may detect a label (the detection target 13 (label) in the example of FIG. 2) bonded to a first pasteboard (the pasteboard 12 of the recording sheet 11 from which transmissive light is to be detected in the example of FIG. 2) having an elongated shape with transmissive light. The reflective sensor may detect a mark (the detection target 13 (mark) in the example of FIG. 2) on a second pasteboard (the pasteboard 12 of the recording sheet 11 from which reflective light is to be detected in the example of FIG. 2) having an elongated shape with reflective light. The controller may adjust a total resistance of the variable resistance circuit by controlling the shift register so that the detection value of the optical sensor at a location (the detection point P in the example of FIG. 1 or the reflective detection point P1 in the example of FIG. 7) of the first pasteboard or the second pasteboard equates with a predetermined value.

The printing apparatus may further include a first storage section (the first storage section 311 in the example of FIG. 4). The controller may store, in the first storage section, a control value for the shift register which is used when the detection value of the optical sensor at the location of the first pasteboard or the second pasteboard equates with the predetermined value. When the optical sensor detects the label or the mark again, the controller may read the control value from the first storage section and controls the shift register by using the control value.

In the printing apparatus, a substrate (the substrate 411 in the example of FIG. 4) on which the variable resistance circuit is mounted may be independent of a mount section (the mount section 412 in the example of FIG. 4) on which the optical sensor is mounted.

In the printing apparatus, the optical sensor may be a transmissive sensor that detects a label bonded to a first pasteboard having an elongated shape with transmissive light or a reflective sensor that detects a mark on a second pasteboard having an elongated shape with reflective light. The printing apparatus may further include a second storage section (the second storage section 312 in the example of FIG. 4) that stores a predetermined value related to the detection value of the optical sensor at the location of the first pasteboard or the second pasteboard. The controller may control the shift register by using a predetermined control value and acquires a detection value of the optical sensor at a location of the first pasteboard or the second pasteboard. Then, based on the detection value, the predetermined control value, and the predetermined value stored in the second storage section, the controller may calculate a control value for the shift register.

The configuration example is a method of controlling a printing apparatus (the control method using the printing apparatus 1) that includes a variable resistance circuit including a plurality of resistors intercoupled and one or more drive elements that feed currents through the respective resistors. An optical sensor is coupled to the variable resistance circuit. A shift register outputs signals to the variable resistance circuit to select one or more of the drive elements and to turn on the selected drive elements. A controller acquires a detection value of the optical sensor and controls the shift register based on the detection value. This method includes causing a controller in the printing apparatus to acquire a detection value from the optical sensor and to control the shift register based on the detection value.

To realize the functions of specific components in any apparatus represented by the above printing apparatus 1, a computer system may read a program from a computer-readable recording medium and execute the program. The "computer system" described herein refers to a system that includes: an operating system (OS); and hardware such as peripheral equipment. The "computer-readable recording medium" refers to a portable medium, such as a flexible disk, a magneto-optic disk, a read-only memory (ROM) unit, or a compact disc (CD) or a storage unit, such as a hard disk, disposed inside the computer system. The "computer-readable recording medium" is defined as a unit that can temporally store the program. If the computer system acts as a server or a client that receives the program via a network such as the Internet or a communication line such as a telephone line, volatile memory inside this computer system may correspond to the computer-readable recording medium. For example, the volatile memory is random-access memory (RAM), and the computer-readable recording medium is a nonvolatile recording medium.

The computer system may transmit the above program from its storage unit, for example, to another computer system via a transmission medium or a carrier wave in the transmission medium. The "transmission medium" via which the program is to be transmitted refers to a medium via which information is to be transmitted. Examples of the transmission medium include a network such as the Internet and a communication line such as a telephone line. The program may be used to realize some of the above functions. This program may be a difference file or program for use in realizing the above functions in collaboration with another program prestored in the computer system.

A processor may be used to realize the functions of specific components in any apparatus represented by the printing apparatus 1. For example, the combination of a processor that operates in accordance with information such as a program and a computer-readable recording medium that stores this information may be used to perform the processes in this embodiment. Functions of the processor may be realized by respective hardware units or by an integrated hardware unit. As an example, the processor is implemented in hardware that includes a digital processing circuit and/or an analog processing circuit. As another example, the processor is implemented by one or more circuit devices mounted on a single substrate or one or more circuit elements. Each of the circuit devices may be an integrated circuit (IC); each of the circuit elements may be a resistor or a capacitor.

The processor is, for example, a CPU, a graphics processing unit (GPU), and a digital signal processor (DSP). For example, the processor may be a hardware circuit such as an application specific integrated circuit (ASIC). For example, the processor is implemented by a plurality of CPUs and a hardware circuit containing a plurality of ASICs. For example, the processor is implemented by the combination of a plurality of CPUs and a hardware circuit containing a plurality of ASICs. For example, the processor contains an amplifier circuit that processes an analog signal and/or a filter circuit.

The foregoing embodiment has been described with reference to the drawings; however, specific components in the present disclosure are not limited to those in the embodiment and may be modified within the scopes of the claims.

What is claimed is:

1. A printing apparatus comprising:

a variable resistance circuit that includes a plurality of resistors intercoupled and one or more drive elements that feed currents through the respective resistors;

an optical sensor coupled to the variable resistance circuit;

a shift register that outputs signals to the variable resistance circuit to select one or more of the drive elements and to turn on the selected drive elements; and a controller that acquires a detection value of the optical sensor and that controls the shift register based on the detection value.

2. The printing apparatus according to claim 1, wherein the optical sensor is a transmissive sensor that detects a label bonded to a first pasteboard having an elongated shape with transmissive light or a reflective sensor that detects a mark on a second pasteboard having an elongated shape with reflective light, and the controller adjusts a total resistance of the variable resistance circuit by controlling the shift register so that the detection value of the optical sensor at a location of the first pasteboard or the second pasteboard equates with a predetermined value.

3. The printing apparatus according to claim 2, further comprising a first storage section, wherein the controller stores, in the first storage section, a control value for the shift register which is used when the detection value of the optical sensor at the location of the first pasteboard or the second pasteboard equates with the predetermined value, and when the optical sensor detects the label or the mark again, the controller reads the control value from the first storage section and controls the shift register by using the control value.

4. The printing apparatus according to claim 1, wherein a substrate on which the variable resistance circuit is mounted is independent of a mount section on which the optical sensor is mounted.

5. The printing apparatus according to claim 1, wherein the optical sensor is a transmissive sensor that detects a label bonded to a first pasteboard having an elongated shape with transmissive light or a reflective sensor that detects a mark on a second pasteboard having an elongated shape with reflective light, the printing apparatus further comprising a second storage section that stores a predetermined value related to the detection value of the optical sensor at the location of the first pasteboard or the second pasteboard, and the controller controls the shift register by using a predetermined control value and acquires a detection value of the optical sensor at a location of the first pasteboard or the second pasteboard, and then the controller calculates a control value for the shift register based on the detection value, the predetermined control value, and the predetermined value stored in the second storage section.

6. A method of controlling a printing apparatus, the printing apparatus including a variable resistance circuit that includes a plurality of resistors intercoupled and one or more drive elements that feed currents through the respective resistors, an optical sensor coupled to the variable resistance circuit, and a shift register that outputs signals to variable resistance circuit to select one or more of the drive elements and to turn on the selected drive elements, the method comprising:

causing a controller in the printing apparatus to acquire a detection value from the optical sensor and to control the shift register based on the detection value.

* * * * *